US011913645B2

(12) United States Patent
Vallejo Ruiz et al.

(10) Patent No.: US 11,913,645 B2
(45) Date of Patent: Feb. 27, 2024

(54) COMBUSTOR ASSEMBLY FOR A TURBINE ENGINE

(71) Applicant: General Electric Company, Schenectady, NY (US)

(72) Inventors: Ernesto Andres Vallejo Ruiz, Cincinnati, OH (US); Douglas Craig Anderson, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/329,710

(22) Filed: May 25, 2021

(65) Prior Publication Data

US 2021/0278082 A1 Sep. 9, 2021

Related U.S. Application Data

(62) Division of application No. 16/210,447, filed on Dec. 5, 2018, now Pat. No. 11,047,574.

(51) Int. Cl.
*F23R 3/00* (2006.01)

(52) U.S. Cl.
CPC .... *F23R 3/007* (2013.01); *F23R 2900/00012* (2013.01)

(58) Field of Classification Search
CPC .. F23R 3/007; F23R 2900/00012; F23R 3/60; F01D 9/023
See application file for complete search history.

(56) References Cited

U.S. PATENT DOCUMENTS

| | | | | |
|---|---|---|---|---|
| 6,265,078 | B1 | 7/2001 | Atmur et al. | |
| 6,284,089 | B1 | 9/2001 | Anderson et al. | |
| 6,347,508 | B1 * | 2/2002 | Smallwood | F01D 11/005 60/800 |
| 6,389,801 | B1 * | 5/2002 | Papenburg | F23R 3/007 60/770 |
| 6,436,507 | B1 | 8/2002 | Pannell | |
| 6,851,643 | B2 | 2/2005 | Qiu et al. | |
| 7,141,191 | B2 | 11/2006 | Engwall et al. | |
| 7,229,513 | B2 | 6/2007 | Keith et al. | |
| 7,546,743 | B2 | 6/2009 | Bulman et al. | |
| 7,686,990 | B2 | 3/2010 | Gray | |

(Continued)

FOREIGN PATENT DOCUMENTS

| | | |
|---|---|---|
| CA | 2934096 A1 | 1/2017 |
| EP | 1900507 A1 | 3/2008 |

(Continued)

*Primary Examiner* — Katheryn A Malatek
(74) *Attorney, Agent, or Firm* — Dority & Manning, P.A.

(57) ABSTRACT

A combustor assembly for a gas turbine engine defining a radial direction and a circumferential direction includes a liner assembly at least partially defining a combustion chamber and including at least one liner formed of a ceramic matrix composite material and extending between a downstream end and an upstream end, the downstream end of the at least one liner defining an interface surface extending along the circumferential direction; and a seal member also formed of a ceramic matrix composite material and bonded to the interface surface of the at least one liner, the seal member defining a downstream surface for contacting an adjacent component to form a seal with the adjacent component.

20 Claims, 8 Drawing Sheets

(56) References Cited

U.S. PATENT DOCUMENTS

| | | | | |
|---|---|---|---|---|
| 7,802,431 | B2 | 9/2010 | Parker | |
| 8,141,370 | B2 | 3/2012 | Bulman et al. | |
| 8,266,914 | B2 | 9/2012 | Hawie et al. | |
| 8,955,330 | B2 | 2/2015 | Narcus et al. | |
| 9,034,128 | B2 | 5/2015 | Lea et al. | |
| 9,102,571 | B2 | 8/2015 | Szweda et al. | |
| 9,945,242 | B2 | 4/2018 | Tura et al. | |
| 10,041,678 | B2 | 8/2018 | Miura et al. | |
| 2006/0280955 | A1 | 12/2006 | Spitsberg et al. | |
| 2008/0116614 | A1 | 5/2008 | Morrison et al. | |
| 2011/0219775 | A1 | 9/2011 | Jarmon et al. | |
| 2011/0281114 | A1 | 11/2011 | Butler | |
| 2013/0251958 | A1 | 9/2013 | Gawn et al. | |
| 2015/0003960 | A1 | 1/2015 | Totten et al. | |
| 2015/0240724 | A1* | 8/2015 | Low | F02C 3/04 60/722 |
| 2016/0215980 | A1 | 7/2016 | Chang | |
| 2018/0017258 | A1 | 1/2018 | Stieg et al. | |
| 2018/0036843 | A1* | 2/2018 | Hucker | F23R 3/002 |
| 2018/0347385 | A1 | 12/2018 | Kishida et al. | |

FOREIGN PATENT DOCUMENTS

| | | | |
|---|---|---|---|
| EP | 3115690 | A1 | 1/2017 |
| FR | 2878608 | A1 | 6/2006 |
| GB | 2485215 | A | 5/2012 |
| JP | 2013127355 | A | 6/2013 |
| WO | WO2013/162989 | A1 | 10/2013 |
| WO | WO2018/013393 | A1 | 1/2018 |

* cited by examiner

COMBUSTOR ASSEMBLY FOR A TURBINE ENGINE

CROSS-REFERENCE TO RELATED APPLICATION

This application is a divisional of U.S. application Ser. No. 16/210,447, filed on Dec. 5, 2018, titled "COMBUSTOR ASSEMBLY FOR A TURBINE ENGINE", which is hereby expressly incorporated herein by reference in its entirety.

FIELD

The present subject matter relates generally to a gas turbine engine, or more particularly to a seal assembly for a combustor assembly for a gas turbine engine.

BACKGROUND

A gas turbine engine generally includes a fan and a core arranged in flow communication with one another. Additionally, the core of the gas turbine engine general includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gasses through the turbine section drives the turbine section and is then routed through the exhaust section, e.g., to atmosphere.

More commonly, non-traditional high temperature materials, such as ceramic matrix composite (CMC) materials, are being used as components within gas turbine engines. For example, given an ability for CMC materials to withstand relatively extreme temperatures, there is particular interest in replacing components within the combustion section of the gas turbine engine with CMC materials. More particularly, an inner liner and an outer liner within the combustion sections of gas turbine engines are more commonly being formed of CMC materials.

By contrast, certain structural components surrounding the inner and outer liners, as well as the components located adjacent to such inner and outer liners, may be formed of a metal material. However, the differing coefficients of thermal expansion between the CMC liners and metal components may make it difficult to form a seal between the two components. Accordingly, a simplified assembly for forming a seal between the CMC components and metal components would be useful.

BRIEF DESCRIPTION

Aspects and advantages of the invention will be set forth in part in the following description, or may be obvious from the description, or may be learned through practice of the invention.

In one exemplary embodiment of the present disclosure, a combustor assembly for a gas turbine engine defining a radial direction and a circumferential direction is provided. The combustor assembly includes a liner assembly at least partially defining a combustion chamber and including at least one liner formed of a ceramic matrix composite material and extending between a downstream end and an upstream end, the downstream end of the at least one liner defining an interface surface extending along the circumferential direction; and a seal member also formed of a ceramic matrix composite material and bonded to the interface surface of the at least one liner, the seal member defining a downstream surface for contacting an adjacent component to form a seal with the adjacent component.

In certain exemplary embodiments the at least one liner of the liner assembly is formed of a plurality of silicon carbide plies, and wherein the seal member is also formed of a plurality of silicon carbide plies.

For example, in certain exemplary embodiments the seal member is bonded to the interface surface of the at least one liner using a silicone-based bonding material.

In certain exemplary embodiments the interface surface of the at least one liner extends continuously along the circumferential direction to form a complete loop.

In certain exemplary embodiments the at least one liner is an at least one outer liner, wherein the downstream surface of the seal member is positioned at least partially outward of the at least one outer liner along the radial direction and at least partially downstream of the at least one outer liner along the axial direction.

In certain exemplary embodiments the at least one liner defines a downstream edge, and wherein the interface surface of the at least one liner is positioned at the downstream edge.

In certain exemplary embodiments the seal member is a first seal member of a plurality of seal members bonded to the interface surface of the at least one liner, and wherein the plurality of seal members are arranged along the circumferential direction and together form a continuous circumferential seal ring.

In certain exemplary embodiments the seal member extends continuously along the circumferential direction to form a circumferential seal ring.

In certain exemplary embodiments the at least one liner includes a plurality of liners spaced along the circumferential direction, and wherein the plurality of liners together define the interface surface.

In certain exemplary embodiments the at least one liner is an outer liner of the combustor assembly.

In another exemplary embodiment of the present invention, a gas turbine engine defining a radial direction and a circumferential direction, the gas turbine engine including a compressor section, a combustor section, and a turbine section arranged in serial flow order, the combustor section including a combustor assembly, is provided. The combustor assembly includes a liner assembly at least partially defining a combustion chamber and including at least one liner formed of a ceramic matrix composite material and extending between a downstream end and an upstream end, the downstream end of the at least one liner defining an interface surface extending along the circumferential direction; and a seal member also formed of a ceramic matrix composite material and bonded to the interface surface of the at least one liner, the seal member defining a downstream surface for contacting an adjacent component to form a seal with the adjacent component.

In certain exemplary embodiments the turbine section includes a first stage of airfoil members, wherein the first stage of airfoil members includes a base defining an upstream end, wherein the upstream end includes a seal plate, and wherein the downstream seal surface contacts the seal plate to form the seal with the seal plate of the base of the first stage of airfoil members.

In certain exemplary embodiments the at least one liner of the liner assembly is formed of a plurality of silicon carbide plies, wherein the seal member is also formed of a plurality of silicon carbide plies, and wherein the seal member is bonded to the interface surface of the at least one liner using a silicone bonding material.

In certain exemplary embodiments the interface surface of the at least one liner extends continuously along the circumferential direction to form a complete loop.

In another exemplary embodiment of the present disclosure, a combustor assembly for a gas turbine engine defining an axial direction, a radial direction, and a circumferential direction is provided. The combustor assembly includes a liner assembly at least partially defining a combustion chamber and including at least one liner extending between a downstream end and an upstream end, the downstream end of the at least one liner defining an interface surface extending along the circumferential direction and along the radial direction, the interface surface including a liner geometry element extending along the radial direction; and a seal member defining a body surface extending along the circumferential direction and along the radial direction and including a seal geometry element extending along the radial direction, the seal geometry element being slidably interfaced with the liner geometry element such that the seal member is moveable along the radial direction relative to the liner.

In certain exemplary embodiments the liner geometry element is one of a dovetail or a dovetail slot, and wherein the seal geometry element is the other of the dovetail or the dovetail slot.

In certain exemplary embodiments the seal member is a first seal member of a plurality of seal members arranged along the circumferential direction, and wherein the plurality of seal members together form a continuous circumferential seal ring.

For example, in certain exemplary embodiments the liner geometry element is a first liner geometry element of a plurality of liner geometry elements of the interface surface spaced along the circumferential direction, and wherein each seal member includes a seal geometry element slidably interfaced with a respective liner geometry element of the plurality of liner geometry elements.

For example, in certain exemplary embodiments the plurality of seal members are coupled to one another.

In certain exemplary embodiments the at least one liner is formed of a ceramic matrix composite material, and wherein the seal member is formed of a metal material.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

DETAILED DESCRIPTION

Figure 1:
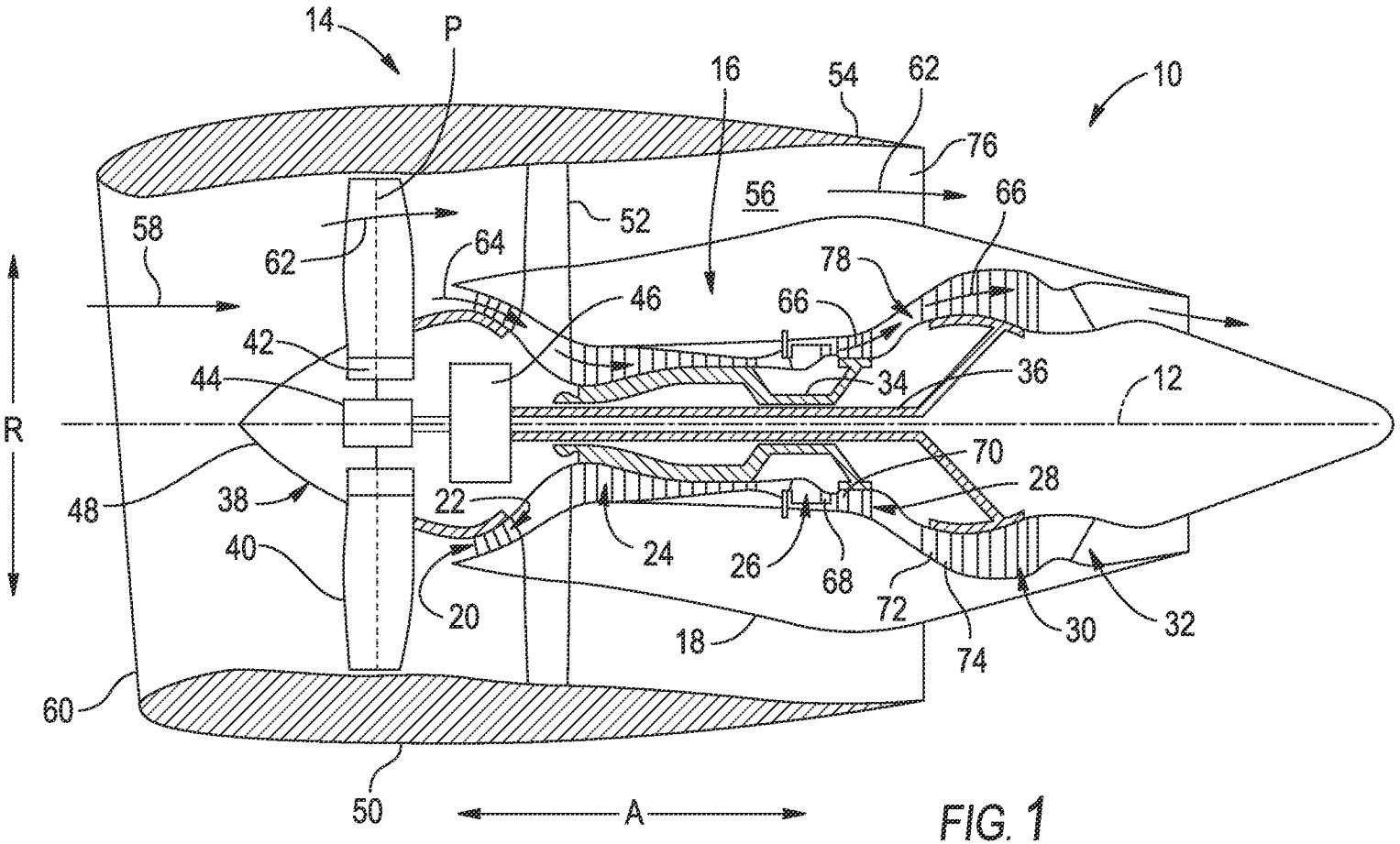
FIG. 1 is a schematic cross-sectional view of an exemplary gas turbine engine according to various embodiments of the present subject matter.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

The word "exemplary" is used herein to mean "serving as an example, instance, or illustration." Any implementation described herein as "exemplary" is not necessarily to be construed as preferred or advantageous over other implementations.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Referring now to the drawings, wherein identical numerals indicate the same elements throughout the Figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference), a radial direction R, and a circumferential direction (i.e., a direction extending about the axial direction A; not depicted). In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

For the embodiment depicted, the fan section 14 includes a variable pitch fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear box 46. The power gear box 46 includes a plurality of gears for stepping down the rotational speed of the LP shaft 36 to a more efficient rotational fan speed.

Referring still to the exemplary embodiment of FIG. 1, the disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. The nacelle 50 is supported relative to the core turbine engine 16 by a plurality of circumferentially-spaced outlet guide vanes 52. A downstream section 54 of the nacelle 50 extends over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

It should be appreciated, however, that the exemplary turbofan engine 10 depicted in FIG. 1 is by way of example only, and that in other exemplary embodiments, the turbofan engine 10 may have any other suitable configuration. For example, in other exemplary embodiments the turbofan engine 10 may be any other suitable aeronautical gas turbine engine, such as a turboshaft engine, turbojet engine, turboprop engine, etc. Further, in still other exemplary embodiments, aspects of the present disclosure may be incorporated into any other suitable gas turbine engine, e.g., including any suitable number or configuration of shafts, compressors, turbines, etc. Moreover, although depicted as an aeronautical gas turbine engine, in other embodiments, aspects of the present disclosure may be incorporated into a land-based gas turbine engine, an aeroderivative gas turbine engine, etc.

Figure 2:
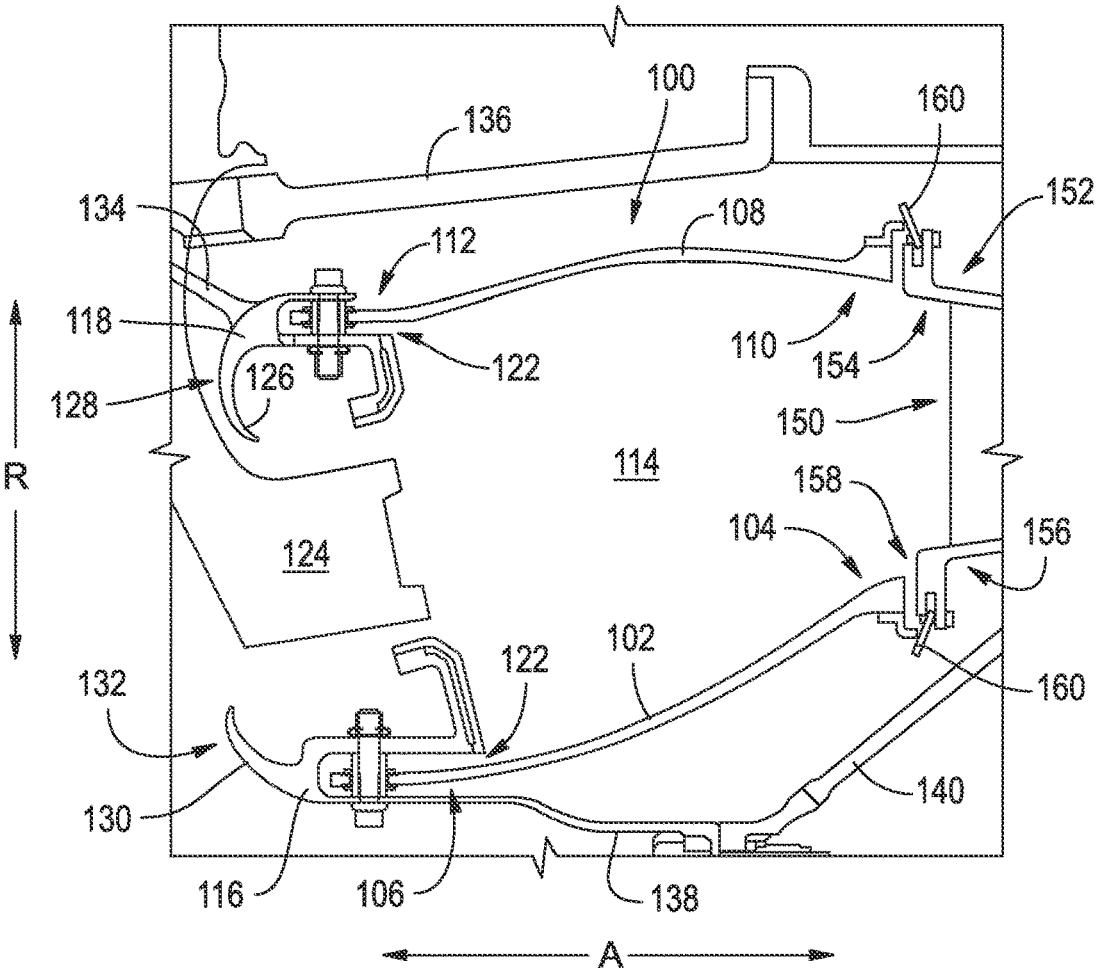
FIG. 2 is a schematic, cross-sectional view of a combustor assembly in accordance with an exemplary embodiment of the present disclosure.

Referring now to FIG. 2, a close-up cross-sectional view is provided of a combustor assembly 100 in accordance with an exemplary embodiment of the present disclosure. For example, the combustor assembly 100 of FIG. 2 may be positioned in the combustion section 26 of the exemplary turbofan engine 10 of FIG. 1. More particularly, FIG. 2 provides a side, cross-sectional view of the exemplary combustor assembly 100 of FIG. 2.

As shown, the combustor assembly 100 generally includes a liner assembly including at least one liner. Specifically, for the embodiment shown, the at least one liner of the liner assembly includes an inner liner 102 extending between a downstream end 104 (or aft end for the embodiment shown) and an upstream end 106 (or forward end for the embodiment shown) generally along the axial direction A, as well as an outer liner 108 also extending between a downstream end 110 and an upstream end 112 generally along the axial direction A. The inner and outer liners 102, 108 together at least partially define a combustion chamber 114 therebetween. As will be appreciated, for the embodiment shown the combustor assembly 100 is configured as an annular combustor, such that the inner and outer liners 102, 108 each extends along a circumferential direction C (see below) to define an circular/annular shape about a central axis (e.g., axis 12), and likewise such that the combustion chamber 114 is an annular combustion chamber. For example, the outer liner 102 may extend continuously along the circumferential direction C, or alternatively may include a plurality of liners forming a continuous outer liner for the combustor assembly 100. Similarly, the inner liner 108 may extend continuously along the circumferential direction C, or alternatively may include a plurality of liners forming a continuous inner liner for the combustor assembly 100. Such a configuration will be discussed in greater detail below.

Additionally, the inner and outer liners 102, 108 are each attached to an annular dome. More particularly, the annular dome includes an inner dome section 116 attached to the upstream end 106 of the inner liner 102 and an outer dome section 118 attached to the upstream end 112 of the outer liner 108. The inner and outer dome sections 116, 118 may be formed integrally (or alternatively may be formed of a plurality of components attached in any suitable manner) and may also each extend along the circumferential direction C to define an annular shape. The inner and outer dome sections 116, 118 each also at least partially define a slot 122 for receipt of the upstream end 106 of the inner liner 102, and the upstream end 112 of the outer liner 108, respectively.

The combustor assembly 100 further includes a plurality of fuel air mixers 124 spaced along a circumferential direction C and positioned at least partially within the annular dome. More particularly, the plurality of fuel air mixers 124 are disposed at least partially between the outer dome section 118 and the inner dome section 116 along the radial direction R. Compressed air from the compressor section of the turbofan engine 10 flows into or through the fuel air mixers 124, where the compressed air is mixed with fuel and ignited to create the combustion gases 66 within the combustion chamber 114. The inner and outer dome sections 116, 118 are configured to assist in providing such a flow of compressed air from the compressor section into or through the fuel air mixers 124. For example, the outer dome section 118 includes an outer cowl 126 at an upstream end 128 and the inner dome section 116 similarly includes an inner cowl 130 at an upstream end 132. The outer cowl 126 and inner cowl 130 may assist in directing the flow of compressed air from the compressor section 26 into or through one or more of the fuel air mixers 124.

Moreover, the inner and outer dome sections 116, 118 each include attachment portions configured to assist in mounting the combustor assembly 100 within the turbofan engine 10. For example, the outer dome section 118 includes an attachment extension 134 configured to be mounted to an outer combustor casing 136 and the inner dome section 116 includes a similar attachment extension 138 configured to attach to an annular support member 140 within the turbofan engine 10. In certain exemplary embodiments, the inner dome section 116 may be formed integrally as a single annular component, and similarly, the outer dome section 118 may also be formed integrally as a single annular component.

It should be appreciated, however, that in other exemplary embodiments, the inner dome section 116 and/or the outer dome section 118 may alternatively be formed by one or more components being joined in any suitable manner. For example, with reference to the outer dome section 118, in certain exemplary embodiments, the outer cowl 126 may be formed separately from the outer dome section 118 and attached to the upstream end 128 of the outer dome section 118 using, e.g., a welding process. Similarly, the attachment extension 134 may also be formed separately from the outer dome section 118 and attached to the upstream end 128 of the outer dome section 118 using, e.g., a welding process. Additionally, or alternatively, the inner dome section 116 may have a similar configuration.

For the embodiment depicted, the at least one liner of the liner assembly, and more specifically, the inner liner 102 and the outer liner 108, are each formed of a ceramic matrix composite (CMC) material, which is a non-metallic material having high temperature capability. Exemplary CMC materials utilized for such liners 102, 108 may include silicon carbide, silicon, silica or alumina matrix materials and combinations thereof. Ceramic fibers may be embedded within the matrix, such as oxidation stable reinforcing fibers including monofilaments like sapphire and silicon carbide (e.g., Textron's SCS-6), as well as rovings and yarn including silicon carbide (e.g., Nippon Carbon's NICALON®, Ube Industries' TYRANNO®, and Dow Corning's SYLRAMIC®), alumina silicates (e.g., Nextel's 440 and 480), and chopped whiskers and fibers (e.g., Nextel's 440 and SAFFIL®), and optionally ceramic particles (e.g., oxides of Si, Al, Zr, Y and combinations thereof) and inorganic fillers (e.g., pyrophyllite, wollastonite, mica, talc, kyanite and montmorillonite). At least certain CMC materials may have coefficients of thermal expansion in the range of about $1.3\times10^{-6}$ in/in/° F. to about $3.5\times10^{-6}$ in/in/° F. in a temperature of approximately 1000-1200° F.

Referring still to FIG. 2, the combustor assembly 100 further includes features for forming a seal with a component of the gas turbine engine positioned adjacent to the combustor assembly 100. More specifically, for the embodiment shown, the combustor assembly 100 is configured to form a seal with a first stage of airfoil members 150 of the turbine section of the gas turbine engine. The first stage of airfoil members 150 is, for the embodiment shown, a first stage of turbine nozzles, and includes a base defining an upstream end. More specifically, the first stage of airfoil members 150 includes an outer base 152 defining an upstream end 154 and an inner base 156 defining an upstream end 158. The upstream end 154 of the outer base 152 and the upstream end 158 of the inner base 156 each includes a seal plate 160. As will be appreciated from the discussion herein, the features of the combustor assembly 100 are configured to form a seal with the seal plates 160 of the upstream end 154 of the inner base 156 and the upstream end 158 of the outer base 152. It will be appreciated, that as used herein, the term "seal," as may be defined between two components, refers to the two components defining a relatively small, measured gap or, no gap, therebetween to limit an allowable airflow therebetween or prevent any airflow therebetween. Accordingly, in certain exemplary embodiments, a seal may refer to two components contacting one another and forming a substantially airtight seal, or alternatively may refer to two components defining a relatively small, measured gap therebetween to constrain an airflow therebetween in a desired manner.

Figure 3:
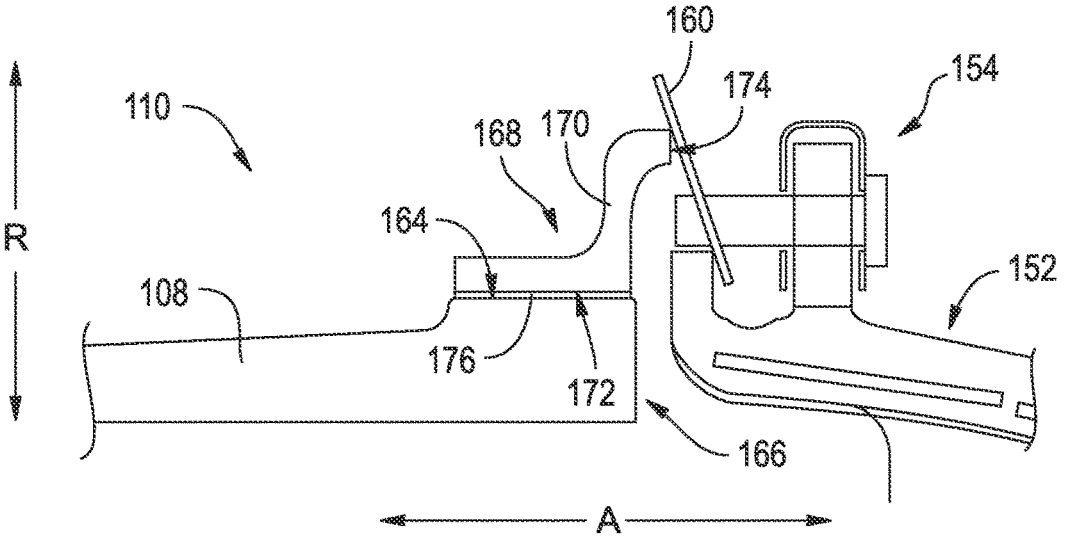
FIG. 3 is a close-up, schematic, cross-sectional view of a downstream end of an outer liner of the exemplary combustor assembly of FIG. 2 in accordance with an exemplary embodiment of the present disclosure.

More specifically, referring now also to FIG. 3, providing a close-up view of the downstream end 110 of the outer liner 108 of the at least one liner of the liner assembly, as is depicted, the downstream end 110 of the outer liner 108 defines an interface surface 164. For the embodiment shown, the interface surface 164 defined by the outer liner 108 at the downstream end 110 is more specifically positioned at a downstream edge 166 of the outer liner 108 and extends generally along the axial direction A, and as will be explained in greater detail below, along the circumferential direction C. It will be appreciated, that as used herein, the term "downstream end" of a particular liner refers to a downstream section of the liner comprising less than twenty percent of an axial length of the liner.

Further, the combustor assembly 100 includes a seal member 168 bonded to the interface surface 164 of the at least one liner of the liner assembly, or more specifically, to the interface surface 164 of the outer liner 108. More specifically, the seal member 168 includes a body 170 defining a body surface 172 and a downstream surface 174. The body surface 172 is bonded to the interface surface 164 of the outer liner 108, and the downstream surface 174 is configured to contact an adjacent component to form a seal with the adjacent component. More specifically, the downstream surface 174 of the seal member 168 is, for the embodiment shown, positioned at least partially outward of the outer liner 108 along the radial direction R and at least the partially downstream, or forward, of the outer liner 108 along the axial direction A. In such a manner, it will be appreciated that for the exemplary embodiment depicted, the downstream surface 174 of the seal member 168 is configured to contact the seal plate 160 of the outer base 152 of the first stage of airfoil members 150 to form a seal with the seal plate 160, and thus the first stage of airfoil members 150.

In such a manner, the seal member 168 may form a seal between the downstream end 110 of the outer liner 108 and an aft-adjacent component of the gas turbine engine (i.e., the first stage of airfoil members 150 for the embodiment shown).

As noted above, the outer liner 108 is formed of a ceramic matrix composite material. Further, for the embodiment shown, the seal member 168 is formed of a ceramic matrix composite material. For example, in at least certain exemplary embodiments, the outer liner 108 and the seal member 168 may be formed of a plurality of silicon carbide plies. With such an exemplary embodiment, the seal member 168 may be bonded to the interface surface 164 of the outer liner 108 using a silicone-based bonding material 176. In such a manner, each of the components may thermally expand in the same manner during operation.

Figure 4:
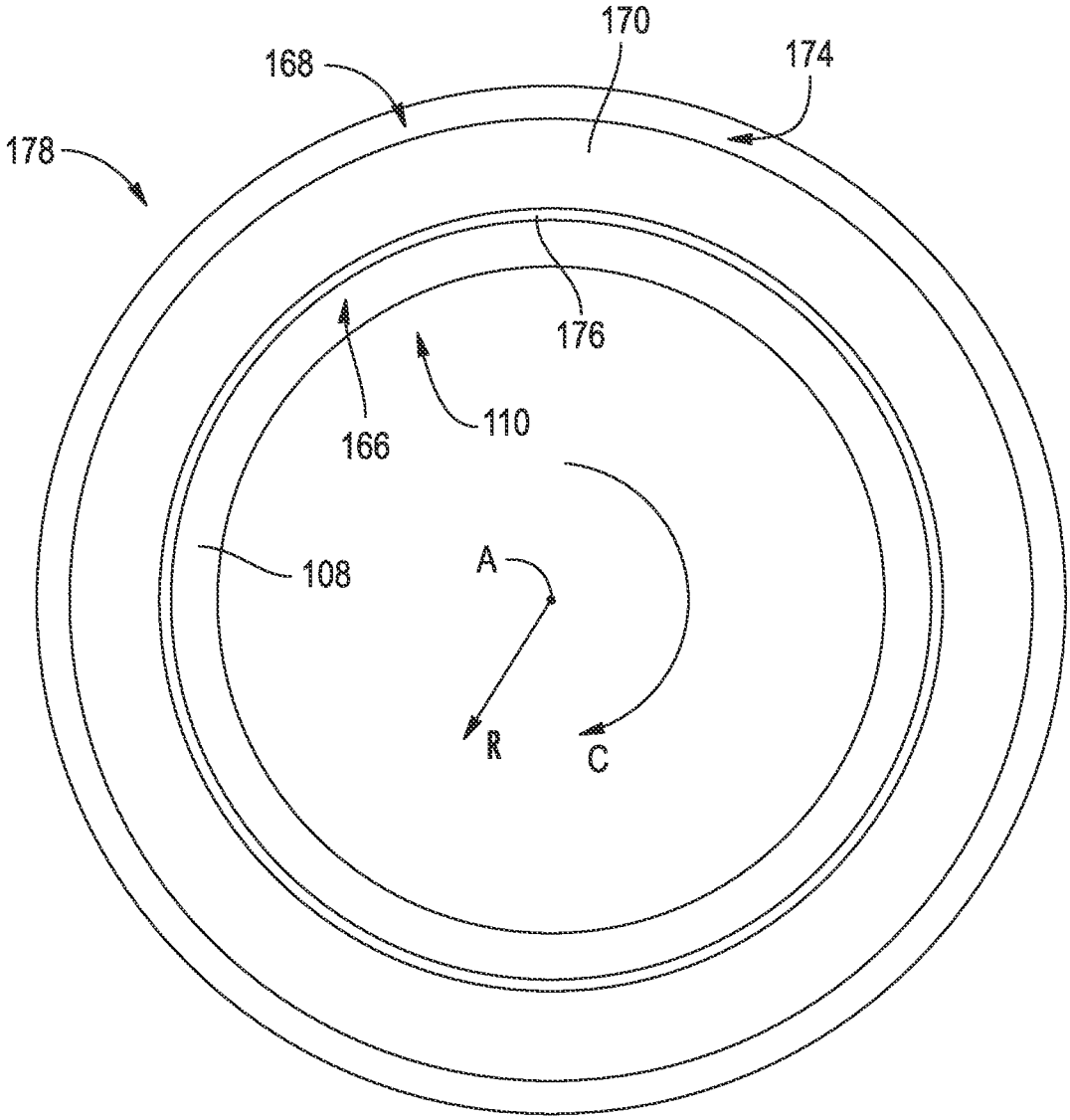
FIG. 4 is a schematic view of the downstream end of the outer liner of FIG. 3 as viewed along an axial direction of the gas turbine engine.

Referring now to FIG. 4, providing a view along the axial direction A of the downstream end 110 of the outer liner 108 and the seal member 168 described above with reference to FIGS. 2 and 3, it will be appreciated that the seal member 168 extends continuously in the circumferential direction C to form a circumferential seal ring 178 and positioned at least partially over the downstream end 110 of the outer liner 108 (which may define a similar annular shape). As such, it will be appreciated that the exemplary seal member 168 depicted is configured as a one-piece member, formed integrally with, e.g., no seams or joints. In such a manner, the seal member 168 may be slid onto the interface surface 164 in unison and bonded thereto. Briefly, it will further be appreciated that the downstream surface 174 of the seal member 168 also extends continuously in the circumferential direction C to form a continuous, three hundred and sixty degree circle. The seal member 168 may therefore form a continuous seal with the downstream end 110 of the outer liner 108, and further the downstream surface 174 may, in turn, form a seal with the adjacent component in the gas turbine engine, such as the seal plate 160.

Figure 5:
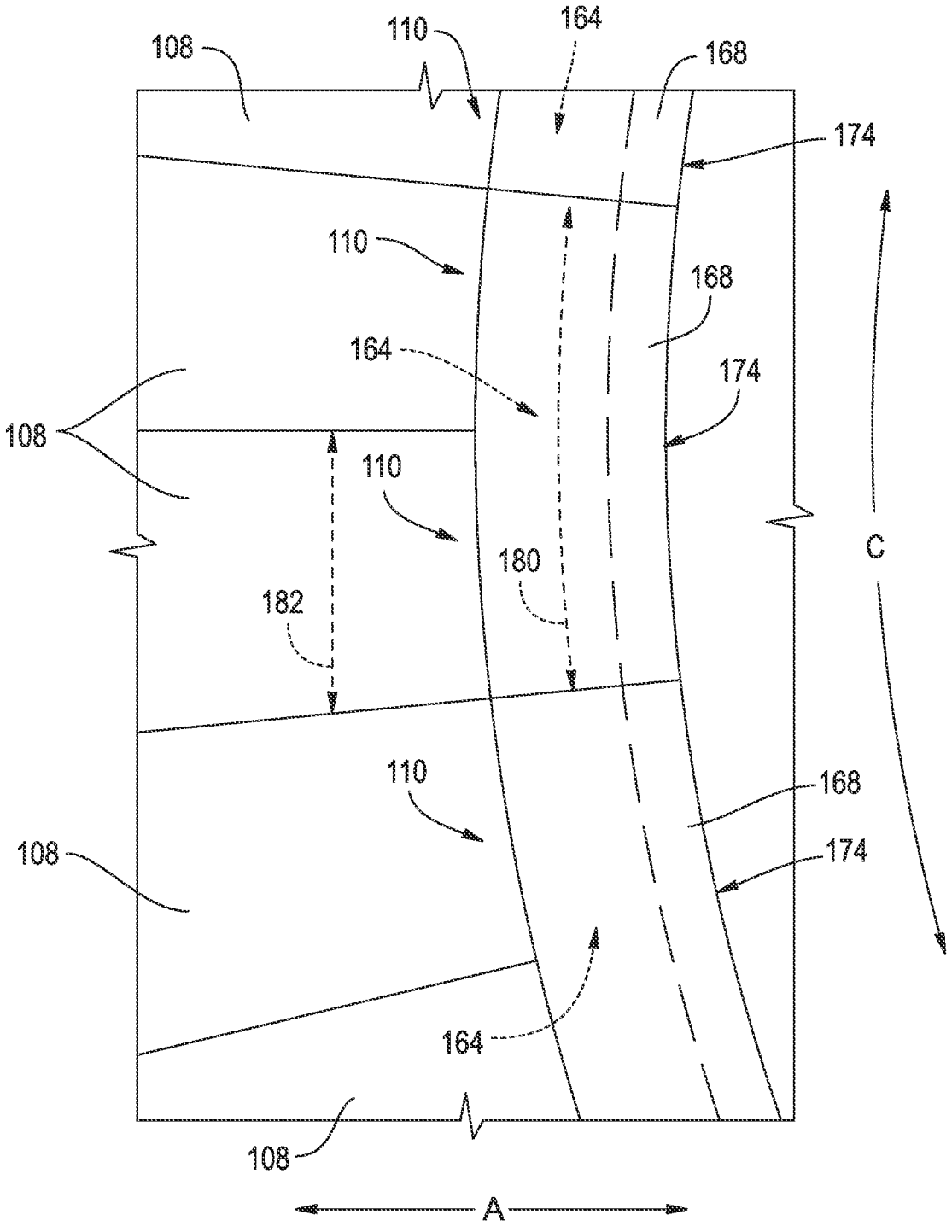
FIG. 5 is a schematic view of a downstream end of a liner assembly of a combustor assembly in accordance with another exemplary embodiment of the present disclosure as viewed along a radial direction of the gas turbine engine.

It will be appreciated, however, that in other embodiments, any other suitable configuration may be provided for the combustor assembly 100, including the liner assembly and the seal member 168. For example, referring now to FIG. 5, an alternative exemplary embodiment of the liner assembly, and more specifically, the outer liner 108, as well as the seal member 168 is provided. More specifically, FIG. 5 depicts an overhead, plan view of a downstream end 110 of an outer liner 108 of a liner assembly, with a seal member 168 in accordance with another exemplary embodiment of the present disclosure attached thereto.

The exemplary liner assembly may be configured in a similar manner to the exemplary liner assembly described above with reference to FIGS. 2 through 4. However, for the embodiment shown, the at least one outer liner 108 of the liner assembly is not a single, continuously-extending outer liner 108, and instead is a plurality of outer liners 108 arranged together to form an effectively-continuous circumferential outer liner for the combustor assembly 100. In such a manner, it will be appreciated that the plurality of outer liners 108 are spaced along the circumferential direction C, and that the plurality of liners together define the interface surface 164. Moreover, with such an exemplary embodiment, the interface surface 164 defined by the plurality of outer liners 108 again extends continuously in the circumferential direction C to form a complete loop (see FIG. 4).

Moreover, for the exemplary embodiment depicted, the seal member 168 is a first seal member 168 of a plurality of seal members 168 of the combustor assembly 100. Each of the plurality of seal members 168 may be bonded to the interface surface 164, e.g., in the same manner the seal member 168 of FIGS. 2 through 4 is bonded to the interface surface 164. Each of the plurality of seal members 168 are arranged along the circumferential direction C, such that the plurality of seal members 168 together form a continuous circumferential seal ring 178 (similar to as is shown in FIG. 4). Adjacent seal members 168 of the plurality of seal members 168 may further be bonded together in a similar manner that the seal members 168 are bonded to the interface surface 164 of the plurality of liners.

Notably, for the embodiment shown, each of the plurality of seal members 168 defines a circumferential span 180 greater than a circumferential span 182 of the individual liners 108. More specifically, each of the plurality of seal members 168 defines a circumferential span 180 twice as large as the circumferential span 182 of the individual liners 108. Such may lead to a stronger combustor assembly 100. However, in other embodiments, the plurality of the seal members 168 each define a circumferential span 180 equal to the circumferential span 182 of the individual liners 108, or the circumferential span 182 of the individual liners 108 may be greater than the circumferential span 180 of the plurality of seal members 168.

Figure 6:
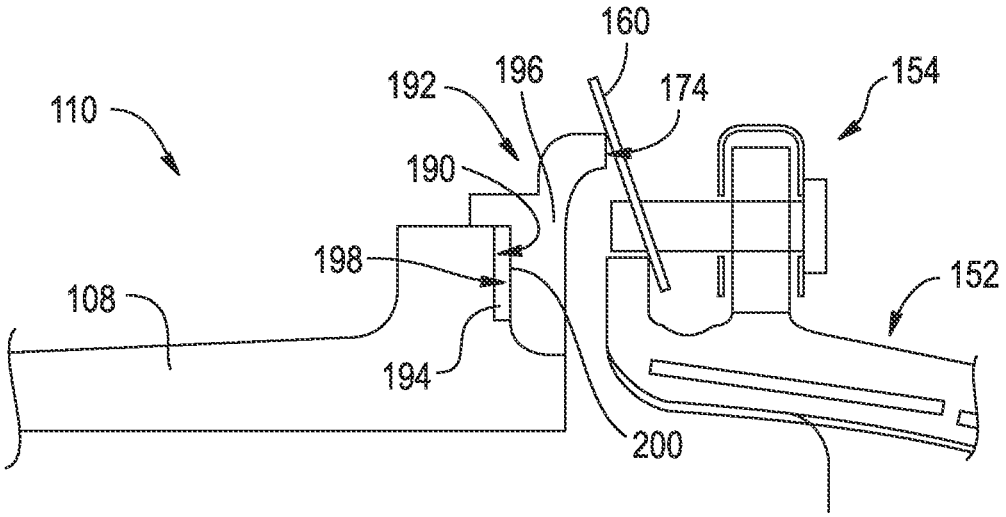
FIG. 6 is a close-up, schematic, cross-sectional view of a downstream end of an outer liner of a combustor assembly in accordance with an exemplary embodiment of the present disclosure exposed to non-operational temperatures.

Referring now to FIG. 6, a close-up view of a downstream end 110 of an at least one liner of a liner assembly and seal member 192 of a combustor assembly 100 in accordance with another exemplary embodiment of the present disclosure is provided. The exemplary combustor assembly 100 of FIG. 6 may be configured in a similar manner to the exemplary combustor assembly 100 described above with reference to FIGS. 2 through 5. For example, the combustor assembly 100 includes a liner assembly having at least one liner defining a downstream end 110, and more specifically including an outer liner 108 defining a downstream end 110. The downstream end 110 of the outer liner 108 defines an interface surface 190 extending along the circumferential direction C. Additionally, the combustor assembly 100 includes a seal member 192 positioned at the downstream end 110 of the at least one liner and including a downstream surface 174 configured to form a seal with an adjacent component of the gas turbine engine. As with the embodiments above, for the embodiment shown, the adjacent component is an upstream end 154 of an outer base 152 of the first stage of airflow members 150, and more specifically, a seal plate 160 of the upstream end 154 of the outer base 152.

As with the embodiments discussed above, the outer liner 108 may be formed of a ceramic matrix composite material. However, for the embodiment shown, the seal member 192 is, instead, formed of a metal material. For example, the seal member 192 may be formed of a metal, such as a nickel-based superalloy (which may have a coefficient of thermal expansion of about $8.3\text{-}8.5\times10^{-6}$ in/in/° F. in a temperature of approximately 1000-1200° F.) or cobalt-based superalloy (which may have a coefficient of thermal expansion of about $7.8\text{-}8.1\times10^{-6}$ in/in/° F. in a temperature of approximately 1000-1200° F.). As such, during operation of the gas turbine engine, the seal member 192 may expand relative to the outer liner 108.

Given the mismatch in the coefficients of thermal expansion of the material forming the outer liner 108 and the material forming the seal member 192, the downstream end 110 of the outer liner 108 and the seal member 192 include features to facilitate a relative radial movement during operation of the gas turbine engine. For example, for the embodiment shown, the interface surface 190 of the liner extends generally along the radial direction R, in addition to extending along the circumferential direction C. Further, the interface surface 190 includes a liner geometry element 194 also extending along the radial direction R. Similarly, the seal member 192 includes a body 196 defining a body surface 198 extending along the circumferential direction C and along the radial direction R. The body surface 198 includes a seal geometry element 200 also extending along the radial direction R. The seal geometry element 200 is slidably interfaced with the liner geometry element 194 such that the seal member 192 is movable along the radial direction R relative to the outer liner 108.

Figure 7:
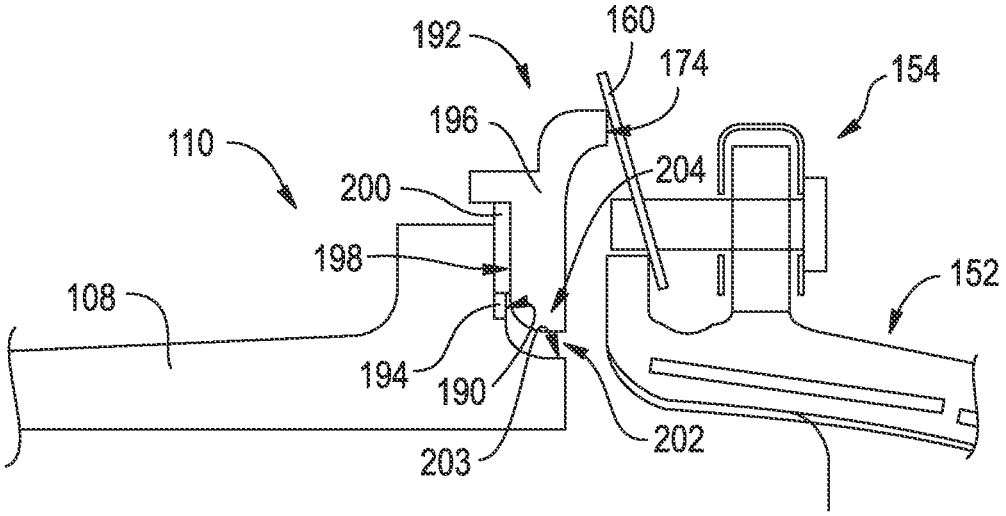
FIG. 7 is a close-up, schematic, cross-sectional view of the downstream end of the outer liner of FIG. 6 exposed to operational temperatures.

For example, referring briefly to FIG. 7, the exemplary outer liner 108 and seal member 192 of FIG. 6 is depicted exposed to operating temperatures of the gas turbine engine. As shown, the seal member 192 is expanded relative to the downstream end 110 of the outer liner 108, such that the body of the seal member 192 defines a gap 202 with an inner end 203 of a groove 204 including the interface surface 190. Such a relative radial movement is facilitated by the slidable interface between the seal geometry element 200 and the liner geometry element 194. However, despite this relative radial movement, the body surface 198 of the seal member 192 is maintained adjacent to the interface surface 190 of the outer liner 108, such that the body surface 198 may maintain a seal with the interface surface 190 despite the relative radial expansion.

Figure 8:
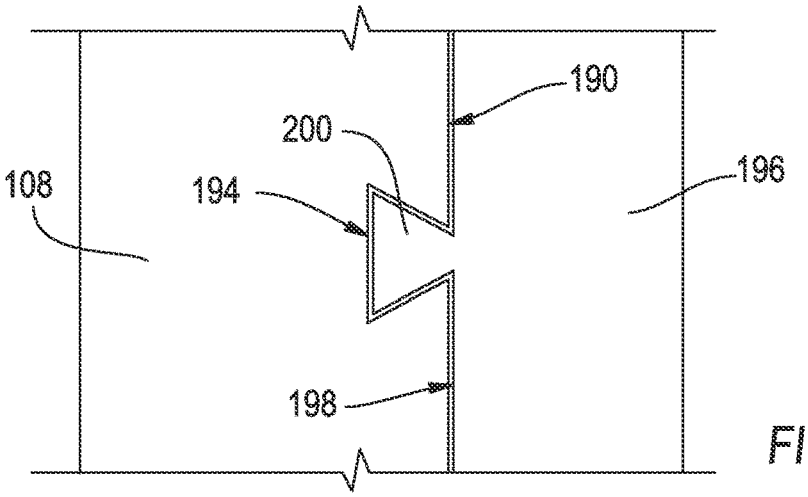
FIG. 8 is a close-up, cross-sectional view of a liner geometry element and a seal geometry element in accordance with an exemplary embodiment of the present disclosure.

Further, it will be appreciated that the seal geometry element 200 and liner geometry element 194 may be configured to constrain the seal member 192 along the axial direction A relative to the outer liner 108 despite the permitted radial movement. For example, in certain exemplary embodiments, the liner geometry element 194 is one of a dovetail or a dovetail slot and the seal geometry element 200 is the other of the dovetail for the dovetail slot. More specifically, referring to FIG. 8, for the embodiment shown the liner geometry element 194 is a dovetail slot and the seal geometry element 200 is a correspondingly shaped dovetail. As such, the seal member 192 may slide along the radial direction R relative to the interface surface 190, but is constrained from moving along the axial direction A relative to the interface surface 190.

Figure 9:
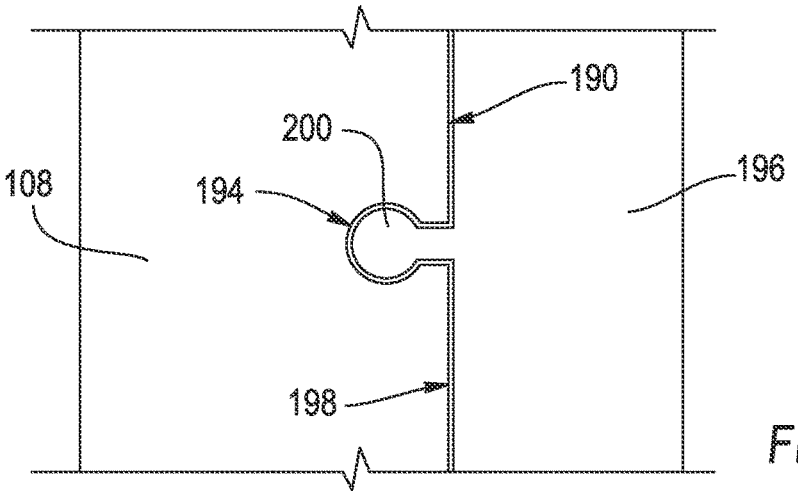
FIG. 9 is a close-up, cross-sectional view of a liner geometry element and a seal geometry element in accordance with another exemplary embodiment of the present disclosure.

However, in other embodiments, any other suitable liner geometry element 194 and seal geometry element 200 may be provided. For example, referring briefly now to FIG. 9, in other embodiments, the liner geometry element 194 may be a circular opening and the seal geometry element 200 may be extension having a circular end fitted within the circular opening of the liner geometry element 194. Again, such a configuration may allow for relative radial movement, but may constrain any relative axial movement.

Figure 10:
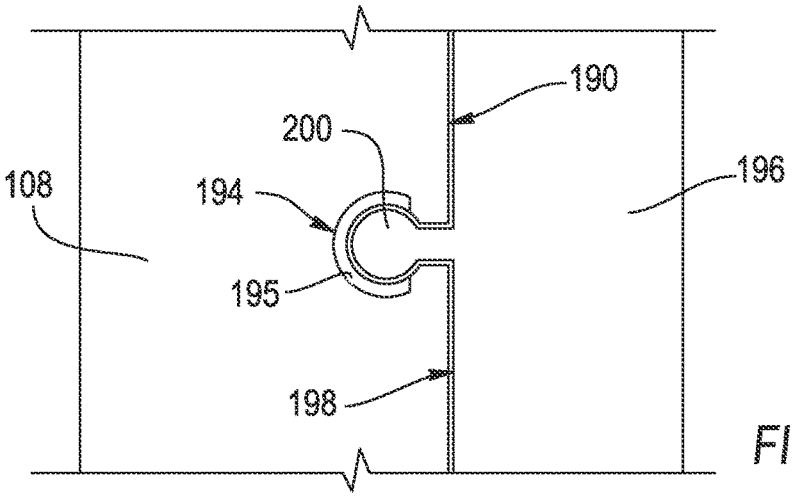
FIG. 10 is a close-up, cross-sectional view of a liner geometry element and a seal geometry element in accordance with yet another exemplary embodiment of the present disclosure.

Moreover, referring now to FIG. 10, providing a close up view of a liner geometry element 194 and a seal geometry element 200 viewed along the radial direction R in accordance with yet another exemplary embodiment of the present disclosure, it will further be appreciated that in at least certain exemplary embodiments, such as the alternative exemplary embodiment of FIG. 10, the outer liner 108 may include a wear coating 195, and more specifically, the liner geometry element 194 may include the wear coating 195 configured to contact the seal geometry element 200, for interfacing with the seal geometry element 200. In such a manner, the seal geometry element 200 may be configured to slide against the wear coating 195 to prevent the seal geometry element 200 from damaging, or prematurely wearing down, the liner geometry element 194 during operation of the gas turbine engine (given the differing materials-ceramic matrix composite versus metal). In such a manner, it will be appreciated that the wear coating 195 may be, e.g., a strip of high temperature allow metal material fixed to the liner, a removable and/or easily replaceable strip of material attached to the liner, etc. However, in other embodiments, the wear coating 195 may have any other suitable configuration, or the combustor assembly may not include a wear coating 195 at all.

Figure 11:
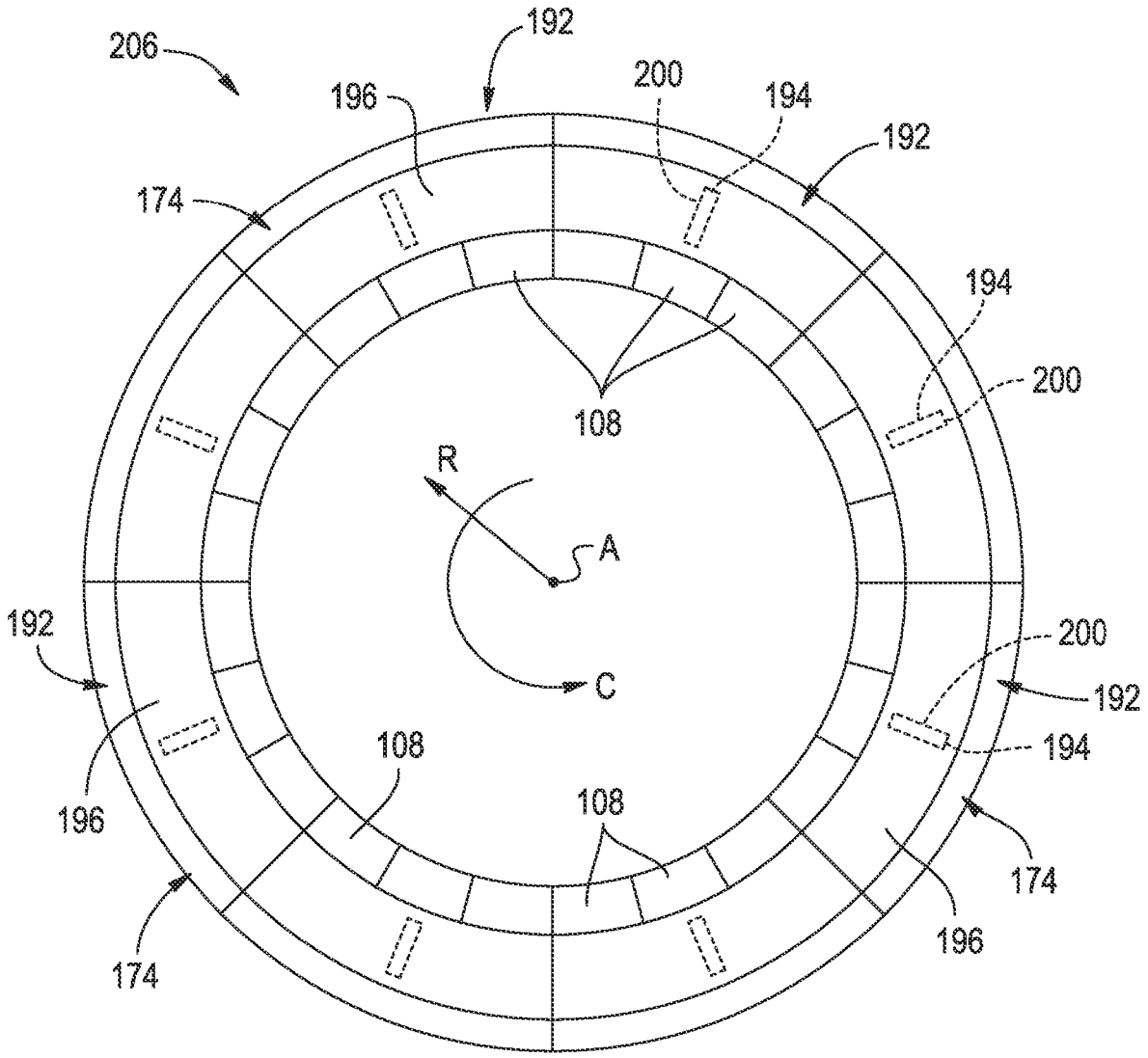
FIG. 11 is a schematic view of the downstream end of the outer liner of FIG. 6 as viewed along an axial direction of the gas turbine engine.
Figure 12:
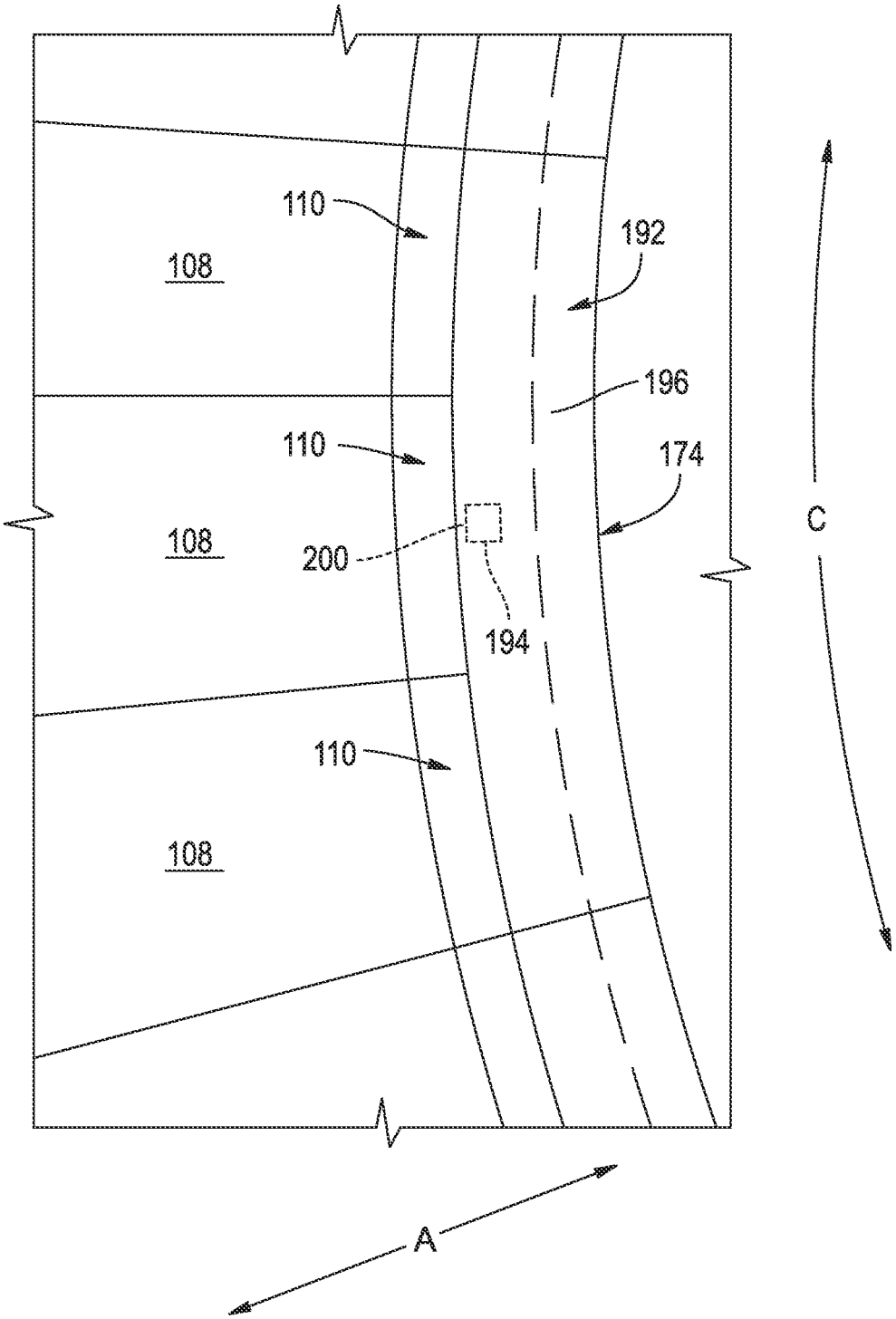
FIG. 12 is a schematic view of the downstream end of the liner assembly of FIG. 6 as viewed along a radial direction of the gas turbine engine.

Referring now to FIGS. 11 and 12, it will be appreciated that the combustor assembly 100 further includes a plurality of seal members 192 and a plurality of outer liners 108 forming a continuously extending outer liner. More specifically, FIG. 11 provides a view of the downstream end 110 of the outer liner 108 (or rather, of the plurality of outer liners 108) and the seal member 192 (or rather, the plurality of seal members 192) viewed along the axial direction A, and FIG. 12, provides a plan view of the downstream end 110 of the outer liner 108 (or rather, of the plurality of outer liners 108) and the seal member 192 (or rather, the plurality of seal members 192) viewed along the radial direction R.

As is shown, the seal member 192 is a first seal member 192 of a plurality of seal members 192 of the combustor assembly 100, and the outer liner 108 is a first outer liner 108 of a plurality of outer liners 108 of the liner assembly of the combustor assembly 100. The plurality of seal members 192 are arranged along the circumferential direction C and together form a continuous circumferential seal ring 206 (FIG. 11). Similarly, the plurality of outer liners 108 are arranged along the circumferential direction C and together form a continuous annular outer liner. Further, as is depicted in phantom, e.g., in FIG. 11, the liner geometry element 194 is a first liner geometry element 194 of a plurality of liner geometry elements 194 of the interface surface 190. The plurality of liner geometry elements 194 are spaced along the circumferential direction C and, for the embodiment shown, are positioned on different outer liners 108. Moreover, each of the plurality of seal members 192 includes a respective seal geometry element 200 slidably interfaced with a respective liner geometry element 194 of the plurality of liner geometry elements 194. Further, each of the plurality of seal members 192 are coupled together (e.g., at their circumferential end joints) once installed at the downstream end 110 of the plurality of outer liners 108. For example, each of the plurality of adjacency members may be welded together or otherwise mechanically fixed to one another.

Furthermore, for the embodiment shown, it will be appreciated that each of the individual seal members 192 defines a larger circumferential span 208 than a respective circumferential span 210 of the individual outer liners 108. More specifically, each of the plurality of seal members 192 defines a circumferential span 208 three times as large as the circumferential span 210 of the individual outer liners 108. However, in other embodiments, the plurality of the seal members 192 may each define a circumferential span 208 equal to the circumferential span 210 of the individual outer liners 108, or the circumferential span 210 of the individual outer liners 108 may be greater than the circumferential span 208 of the plurality of seal members 192.

It will be appreciated, however, that in other exemplary embodiments, any other suitable configuration may be provided for the combustor assembly 100, the gas turbine engine, etc. Moreover, it will be appreciated that although the exemplary seal members described above were configured to form a seal between an outer liner and an outer base of a first stage of airfoil members, in other embodiments, additional or alternative seal members may be provided to form a seal between a downstream end of an inner liner and an inner base of the first stage of airfoil members (see FIG. 2). For example, with such an embodiment the downstream end of the inner liner may define one or more radial openings and an interface surface, and the seal member may include a body having a body surface positioned adjacent to the interface surface, a flange, and a radial member coupled to the flange and extending at least partially into the radial opening of the inner liner. Notably, however, the seal member may be sized to define gaps (similar to gap 202 in FIG. 7) when in cold conditions to allow the seal member to expand during hot conditions (e.g., operating conditions).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine defining an axial direction, a radial direction and a circumferential direction, the combustor assembly comprising:

a liner assembly at least partially defining a combustion chamber and comprising at least one liner formed of a ceramic matrix composite material and extending between a downstream end and an upstream end, the downstream end of the at least one liner defining an interface surface extending along the axial direction and extending along the circumferential direction; and a seal member formed of a ceramic matrix composite material and bonded to the interface surface of the at least one liner at a body surface extending along the axial direction, the seal member defining a downstream surface for contacting an adjacent component to form a seal with the adjacent component, wherein the body surface is a farthest inward surface in the radial direction of the seal member that extends in the axial direction.

2. The combustor assembly of claim 1, wherein the at least one liner of the liner assembly is formed of a plurality of silicon carbide plies, and wherein the seal member is also formed of a plurality of silicon carbide plies.

3. The combustor assembly of claim 2, wherein the seal member is bonded to the interface surface of the at least one liner using a silicone-based bonding material extending entirely across the body surface in the axial direction.

4. The combustor assembly of claim 1, wherein the interface surface of the at least one liner extends continuously along the circumferential direction to form a complete loop.

5. The combustor assembly of claim 4, wherein the at least one liner comprises a plurality of liners spaced along the circumferential direction, and wherein the plurality of liners together extend continuously along the circumferential direction.

6. The combustor assembly of claim 1, wherein the at least one liner is an at least one outer liner, wherein the downstream surface of the seal member is positioned at least partially outward of the at least one outer liner along the radial direction and at least partially downstream of the at least one outer liner along the axial direction.

7. The combustor assembly of claim 1, wherein the at least one liner defines a downstream edge, and wherein the interface surface of the at least one liner is positioned at the downstream edge.

8. The combustor assembly of claim 1, wherein the seal member is a first seal member of a plurality of seal members bonded to the interface surface of the at least one liner, and wherein the plurality of seal members are arranged along the circumferential direction and together form a continuous circumferential seal ring.

9. The combustor assembly of claim 1, wherein the seal member extends continuously along the circumferential direction to form a circumferential seal ring.

10. The combustor assembly of claim 1, wherein the at least one liner comprises a plurality of liners spaced along the circumferential direction, and wherein the plurality of liners together define the interface surface.

11. The combustor assembly of claim 10, wherein the interface surface of the plurality of liners extends continuously along the circumferential direction to form a complete loop.

12. A gas turbine engine defining an axial direction, a radial direction, and a circumferential direction, the gas turbine engine comprising:

a compressor section, a combustor section, and a turbine section arranged in serial flow order, the combustor section comprising a combustor assembly, the combustor assembly comprising:

a liner assembly at least partially defining a combustion chamber and comprising at least one liner formed of a ceramic matrix composite material and extending between a downstream end and an upstream end, the downstream end of the at least one liner defining an interface surface extending along the axial direction and extending along the circumferential direction; and a seal member formed of a ceramic matrix composite material and bonded to the interface surface of the at least one liner at a body surface extending along the axial direction, the seal member defining a downstream surface for contacting an adjacent component to form a seal with the adjacent component, wherein the body surface is a farthest inward surface in the radial direction of the seal member that extends in the axial direction.

13. The gas turbine engine of claim 12, wherein the seal member is bonded to the interface surface of the at least one liner using a silicone-based bonding material extending entirely across the body surface in the axial direction.

14. The gas turbine engine of claim 12, wherein the interface surface of the at least one liner extends continuously along the circumferential direction to form a complete loop.

15. The gas turbine engine of claim 14, wherein the at least one liner comprises a plurality of liners spaced along the circumferential direction, and wherein the plurality of liners together extend continuously along the circumferential direction.

16. The gas turbine engine of claim 12, wherein the at least one liner is an at least one outer liner, wherein the downstream surface of the seal member is positioned at least partially outward of the at least one outer liner along the radial direction and at least partially downstream of the at least one outer liner along the axial direction.

17. The gas turbine engine of claim 12, wherein the at least one liner defines a downstream edge, and wherein the interface surface of the at least one liner is positioned at the downstream edge.

18. The gas turbine engine of claim 12, wherein the seal member is a first seal member of a plurality of seal members bonded to the interface surface of the at least one liner, and wherein the plurality of seal members are arranged along the circumferential direction and together form a continuous circumferential seal ring.

19. The gas turbine engine of claim 12, wherein the seal member extends continuously along the circumferential direction to form a circumferential seal ring.

20. The gas turbine engine of claim 12, wherein the at least one liner comprises a plurality of liners spaced along the circumferential direction, wherein the plurality of liners together define the interface surface, and wherein the interface surface of the plurality of liners extend continuously along the circumferential direction to form a complete loop.

* * * * *